US010087059B1

(12) United States Patent
Dick et al.

(10) Patent No.: US 10,087,059 B1
(45) Date of Patent: Oct. 2, 2018

(54) DOUBLE COLUMN BOOM ATTACHMENT FOR A LIFT TRUCK

(71) Applicant: Custom Mobile Equipment, Inc., Baldwin City, KS (US)

(72) Inventors: Gary Lynn Dick, Baldwin City, KS (US); Elmer J. Vavricek, Gardner, KS (US)

(73) Assignee: Custom Mobile Equipment, Inc., Baldwin City, KS (US)

( * ) Notice: Subject to any disclaimer, the term of this patent is extended or adjusted under 35 U.S.C. 154(b) by 0 days.

(21) Appl. No.: 15/403,997

(22) Filed: Jan. 11, 2017

(51) Int. Cl.
*B66F 9/12* (2006.01)

(52) U.S. Cl.
CPC ..... *B66F 9/12* (2013.01); *B66F 9/122* (2013.01)

(58) Field of Classification Search
CPC .. B66F 9/061; B66F 9/122; B66F 9/12; B66F 9/18; B66C 23/44
USPC ..... 414/607
See application file for complete search history.

(56) References Cited

U.S. PATENT DOCUMENTS 2,732,022 A * 1/1956 Lapsley ..... B60K 1/00 180/6.28
3,788,492 A * 1/1974 Kraft ..... B66C 23/708 212/180
4,392,554 A * 7/1983 Russey ..... B66F 9/08 187/226
4,441,585 A * 4/1984 Macnab ..... B66F 9/08 187/226
4,531,615 A * 7/1985 Wible ..... B66F 9/08 187/227
4,848,520 A * 7/1989 Gibel ..... B66F 9/08 187/223
4,949,816 A * 8/1990 Brown ..... B66F 9/08 187/227
5,000,293 A 3/1991 Brown et al.
2007/0080024 A1* 4/2007 Langenkamp ..... B66F 9/08 187/222
2010/0181147 A1* 7/2010 Simpson ..... B66F 9/08 187/230
2016/0340154 A1* 11/2016 Samples, II ..... B66F 9/061

* cited by examiner

*Primary Examiner* — Mark C Hageman
(74) *Attorney, Agent, or Firm* — Hovey Williams LLP

(57) ABSTRACT

A lift truck is configured to suspend a load above the ground and includes a self-propelled vehicle and a boom assembly. The vehicle defines an operator station to support an operator during lift truck use. The boom assembly includes a bifurcated, upright support frame attached relative to the vehicle and an elongated transverse boom. The transverse boom extends longitudinally to present a proximal mounting end and a distal lifting end configured to support the load in a space below the lifting end. The support frame includes a pair of upright supports that are attached relative to the mounting end to cooperatively support the transverse boom. The supports are laterally spaced apart to cooperatively define an upright support opening that permits an operator to view the load from the operator station by looking through the support opening along a longitudinal line of sight.

21 Claims, 9 Drawing Sheets

DOUBLE COLUMN BOOM ATTACHMENT FOR A LIFT TRUCK

BACKGROUND

1. Field

The present invention relates generally to industrial vehicles. More specifically, embodiments of the present invention concern a lift truck including a vehicle and a boom assembly supported by the vehicle to suspend a load above the ground.

2. Discussion of Prior Art

Conventional lift truck vehicles have long been used in various applications to selectively raise and lower a load. Such vehicles typically include a self-powered chassis and an extendable mast mounted on a forward end of the chassis. The mast is shiftable to raise and lower the load. In some known embodiments, the mast is attached to a fork structure that extends underneath the load. It is also known for some lift truck vehicles to have an elongated boom attached to the mast so that the load can be suspended below the boom.

Lift trucks having a relatively small size often have a centrally located operator station. Such lift trucks also typically have a mast with an opening that permits the operator to look through the mast from the operator station along a longitudinal vehicle axis. Relatively larger lift trucks are known to have an operator station that is laterally offset to one side of the vehicle axis. The position of the offset station permits the operator to view the load by looking around the mast.

However, conventional lift trucks have various deficiencies. For instance, relatively large lift trucks with a mast and a boom attachment are known restrict an operator's view. For instance, such lift trucks severely restrict (or entirely prevent) the operator from viewing the load through the mast. Also, conventional large lift trucks offset the operator station laterally so that the operator can view the load by looking around the mast and the boom. However, such positioning of the station also restrict's the operator's view (e.g., areas on the opposite side of the lift truck).

SUMMARY

The following brief summary is provided to indicate the nature of the subject matter disclosed herein. While certain aspects of the present invention are described below, the summary is not intended to limit the scope of the present invention.

Embodiments of the present invention provide a lift truck that does not suffer from the problems and limitations of the prior art vehicles set forth above.

A first aspect of the present invention concerns a boom attachment operable to be supported by a vehicle to suspend a load above the ground. The boom attachment broadly includes a bifurcated, upright support frame and an elongated transverse boom. The support frame is configured to be removably attached to the vehicle. The elongated transverse boom extends longitudinally to present a proximal mounting end and a distal lifting end configured to support the load in a space below the lifting end. The support frame includes a pair of upright supports that are attached relative to the mounting end to cooperatively support the transverse boom. The supports are laterally spaced apart to cooperatively define an upright support opening that permits an operator to view the load from a location spaced proximally of the support frame by looking through the support opening along a longitudinal line of sight.

A second aspect of the present invention concerns a lift truck configured to suspend a load above the ground. The lift truck broadly includes a self-propelled vehicle and a boom assembly. The vehicle defines an operator station to support an operator during lift truck use. The boom assembly is supported by the vehicle distally of the operator station and is operable to suspend the load above the ground. The boom assembly includes a bifurcated, upright support frame attached relative to the vehicle and an elongated transverse boom. The transverse boom extends longitudinally to present a proximal mounting end and a distal lifting end configured to support the load in a space below the lifting end. The support frame includes a pair of upright supports that are attached relative to the mounting end to cooperatively support the transverse boom. The supports are laterally spaced apart to cooperatively define an upright support opening that permits an operator to view the load from the operator station by looking through the support opening along a longitudinal line of sight.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 6:
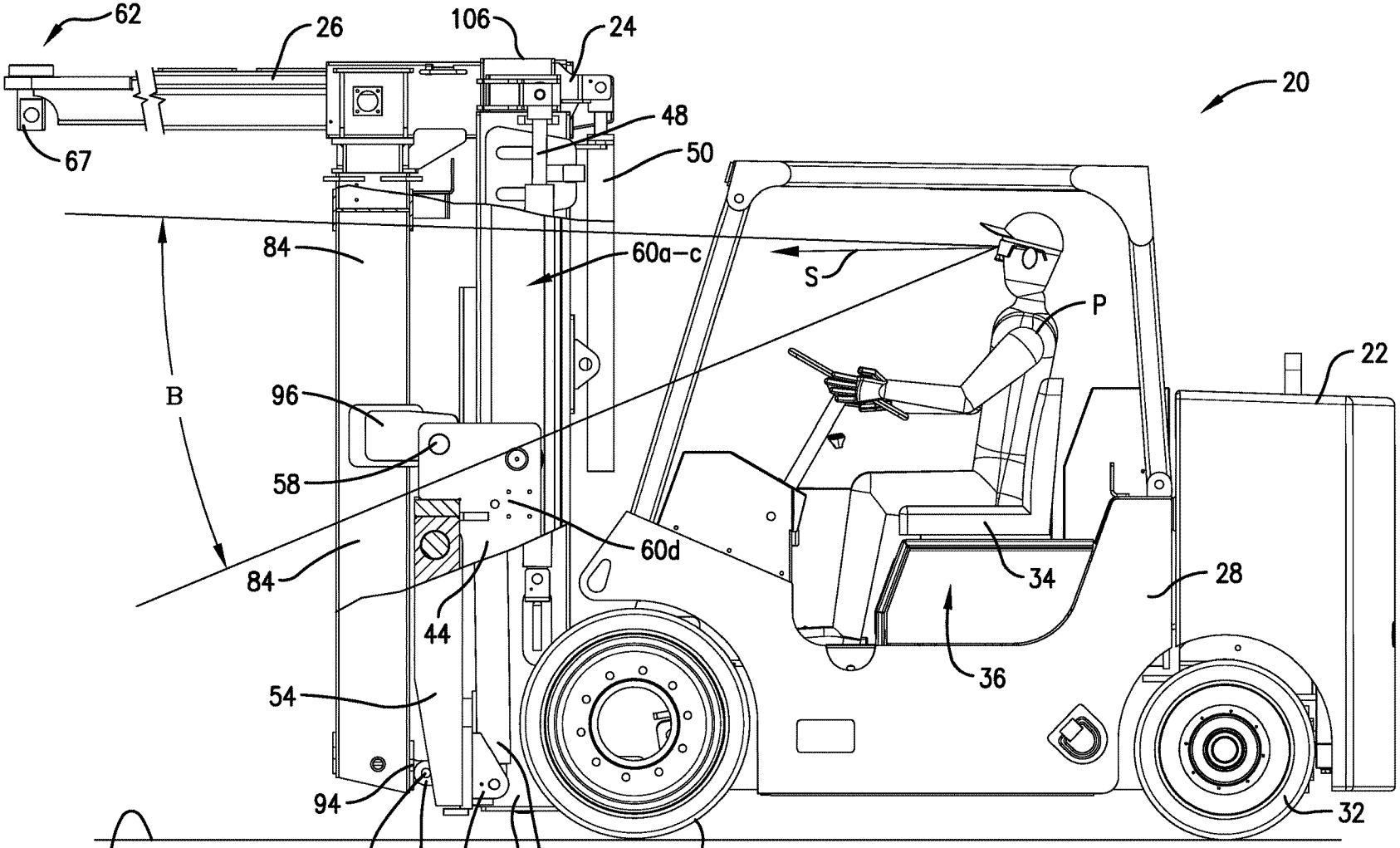
FIG. 6 is a side elevation of the lift truck shown in FIG. 1, showing parts of the boom attachment and the mast being broken away to show an upright support opening and mast openings, with the openings permitting the operator to look forwardly along a longitudinal line of sight through the boom attachment and the mast.
Figure 7:
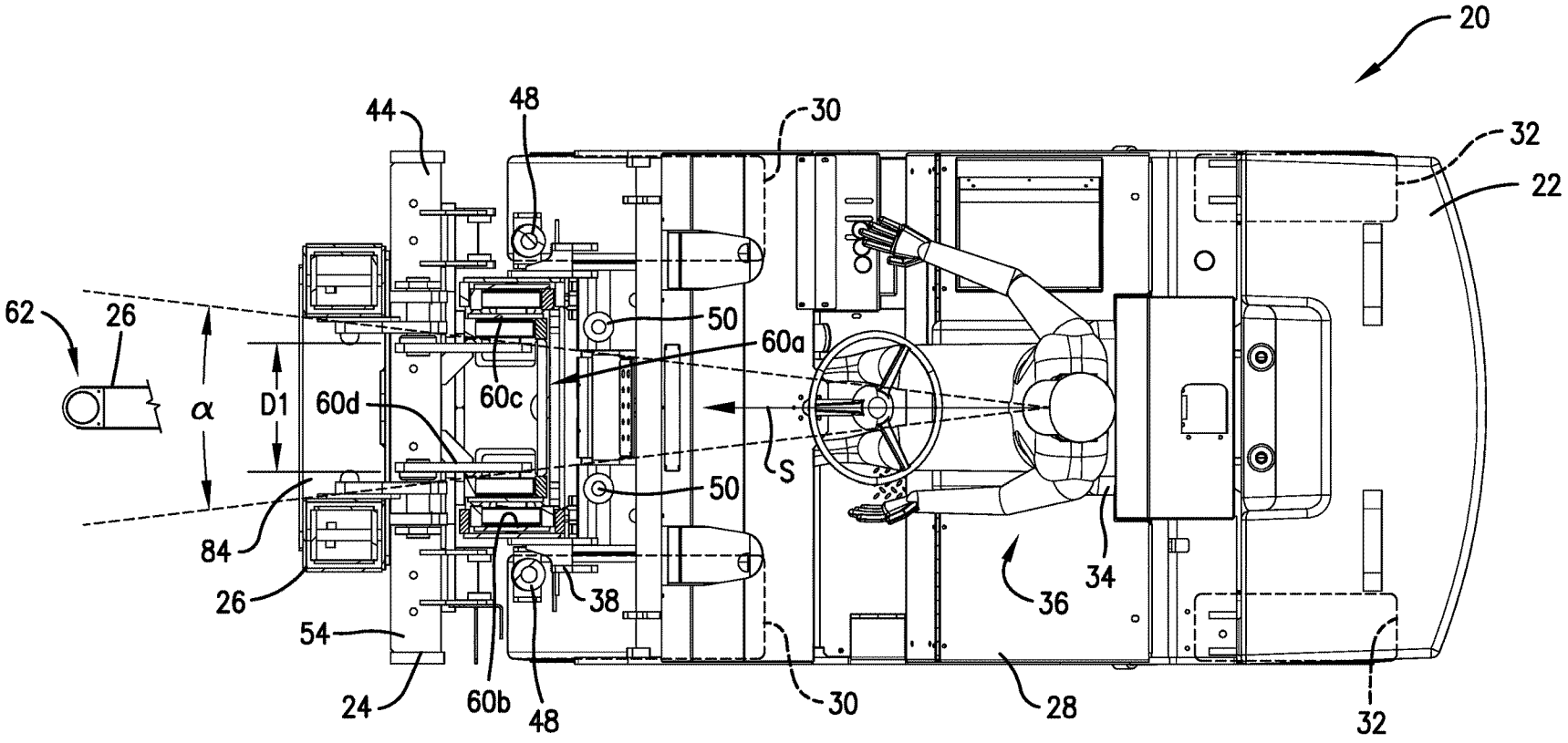
FIG. 7 is a top view of the lift truck shown in FIGS. 1 and 6, showing parts of the boom attachment and the mast being broken away to show the support opening and mast openings.
Figure 8:
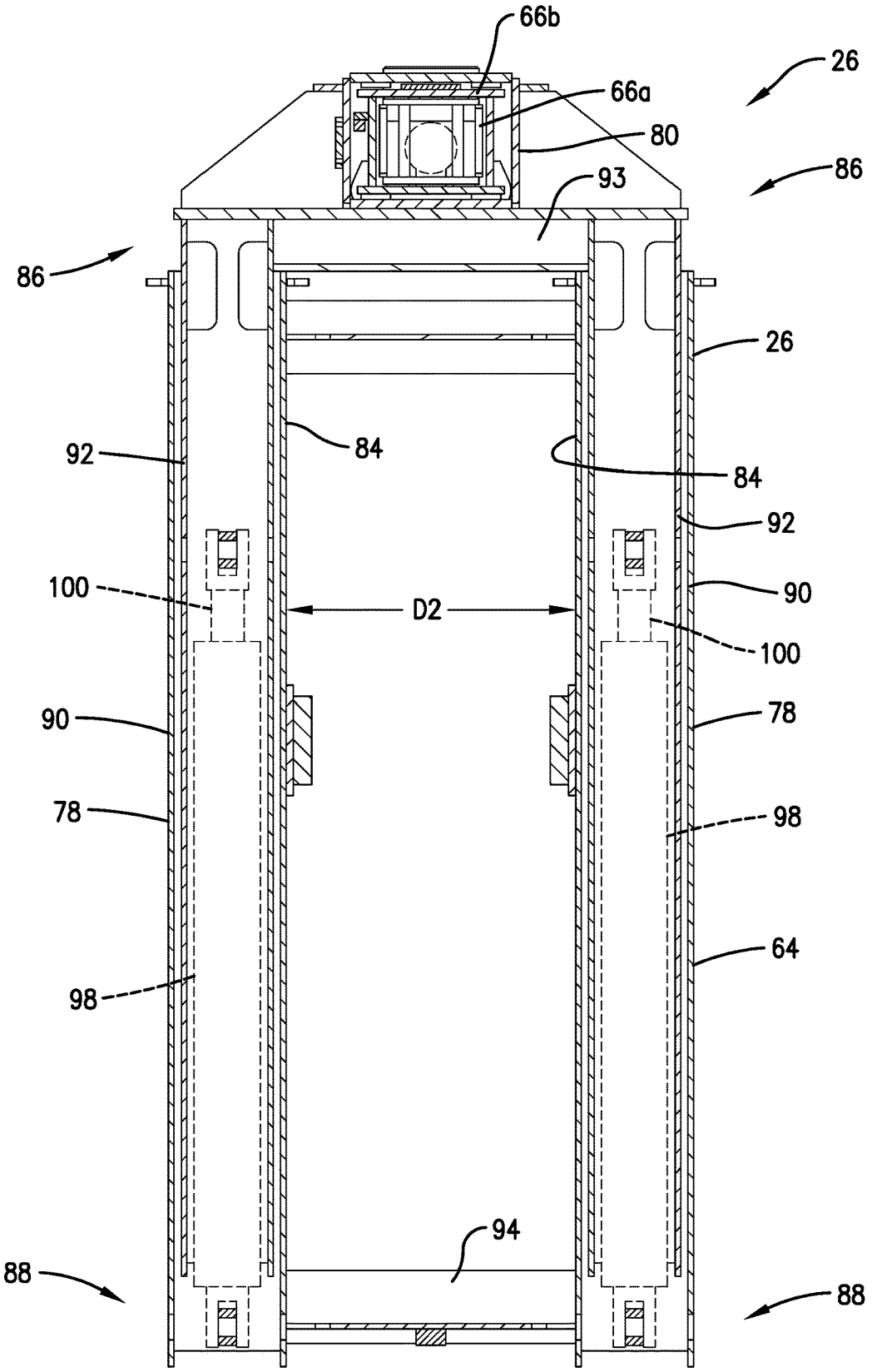
Figure 9:
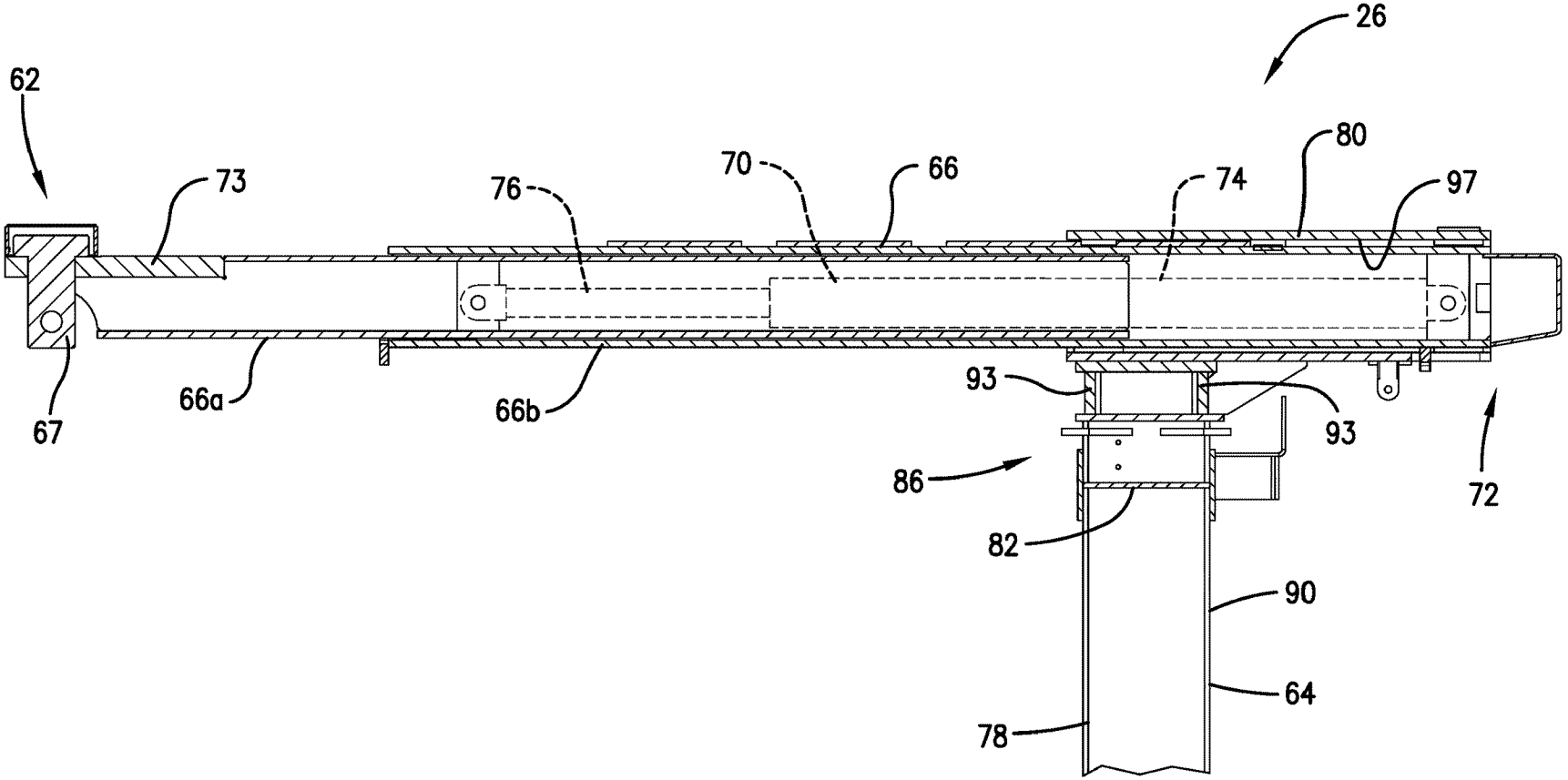

FIG. 8 is a cross section of the boom attachment shown in FIGS. 1-3 and 6-7, showing the shiftable support sections telescopically received within base support sections of the support frame, and with boom lift cylinders being operably mounted within the support sections; and FIG. 9 is a fragmentary cross section of the boom attachment shown in FIGS. 1-3 and 6-8, showing inner and outer boom sections of the transverse boom.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
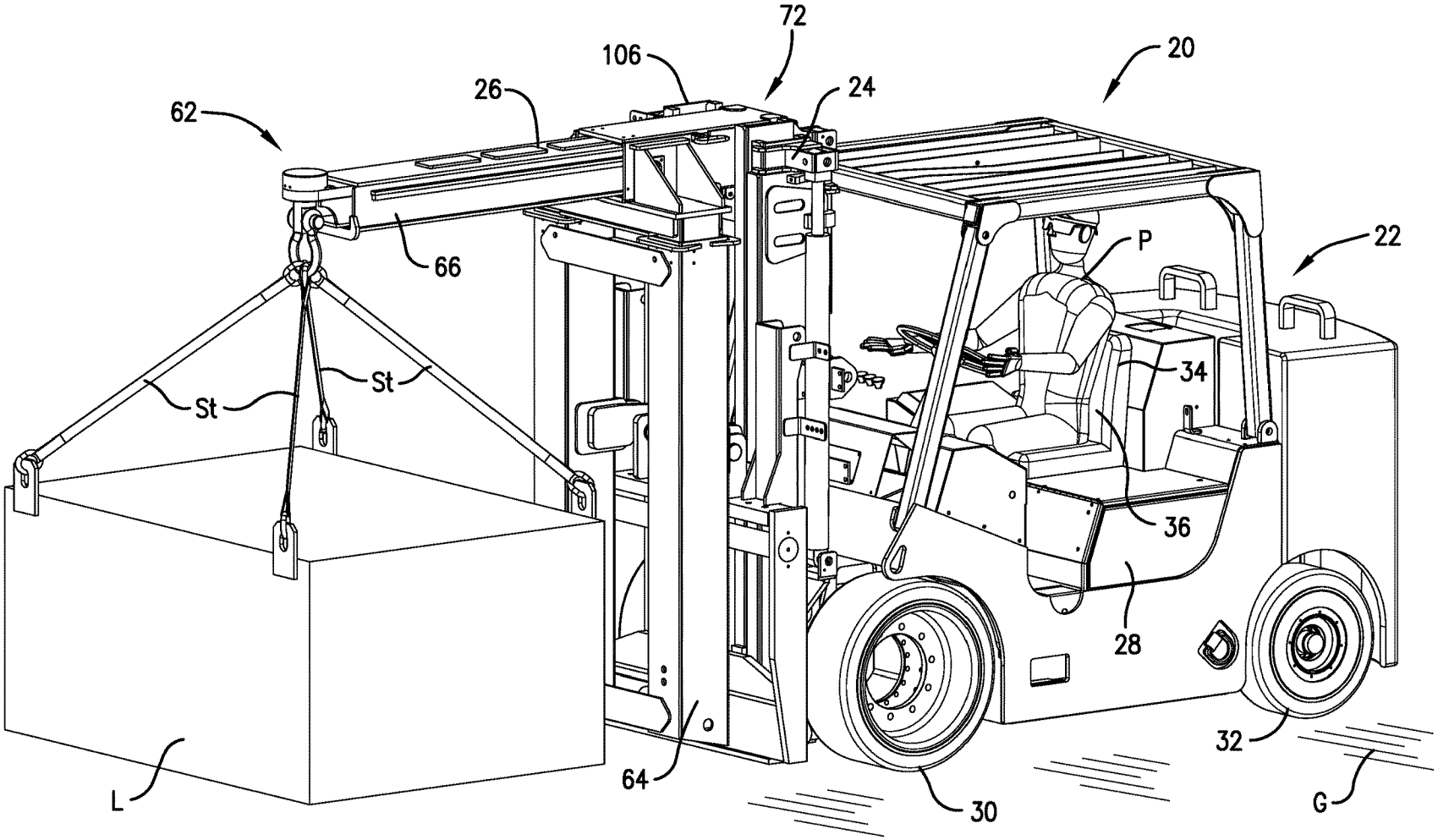
FIG. 1 is a front perspective of a lift truck constructed in accordance with a preferred embodiment of the present invention, showing a self-propelled vehicle, extendable mast, and a boom attachment of the lift truck, with a load being suspended from the boom attachment.

Turning initially to FIGS. 1 and 6, a lift truck 20 is configured to suspend a load L above the ground G. For instance, as done with conventional lifting vehicles, the lift truck 20 can be used to hold the load L in a stationary location. However, as is also customary, the lift truck 20 can move the load L along the ground G and/or move the load L vertically while the load L is suspended. The lift truck 20 preferably includes a self-propelled vehicle 22, an extendable mast 24, and a boom assembly 26.

The illustrated load L is suspended from the boom assembly 26 with straps St. However, it will be appreciated that the boom assembly 26 could be used to support loads of various sizes and shapes. Furthermore, an alternative structure could be used to suspend the load L from the boom assembly 26, such as an alternative strap arrangement.

Turning to FIGS. 1, 6, and 7, the vehicle 22 is operable to shiftably support the mast 24 and boom assembly 26. In the usual manner, the vehicle 22 includes a rolling chassis 28 with front and back wheels 30,32. The vehicle 22 also includes a motive power source (not shown), such as an internal combustion engine or an electric motor, that is mounted within the chassis 28 and powers the vehicle 22.

The illustrated vehicle 22 also preferably includes an operator seat 34 that defines an operator station 36. The seat 34 includes a seat bottom and an upright seat back. As is customary, a person P can be seated in the operator station 36. The operator station 36 is configured to support the person P in a seated position (e.g., while the person P operates the lift truck 20).

The operator station 36 is preferably centrally positioned on the chassis 28. In particular, the station 36 and the seat 34 are preferably spaced laterally between the front wheels 30 and also spaced laterally between the back wheels 32. However, as will be explained in greater detail, the mast 24 and the boom assembly 26 are constructed so that the person P can clearly view the load L while seated at the operator station 36.

Turning to FIGS. 4-7, the illustrated mast 24 shiftably interconnects the boom assembly 26 and the vehicle 22 and thereby supports the boom assembly 26. As will be described, the mast 24 is extendable to move the boom assembly 26 vertically relative to the vehicle 22. The mast 24 preferably includes a mast base 38, a first shiftable mast stage 40, a second shiftable mast stage 42, and a third shiftable mast stage 44.

Figure 4:
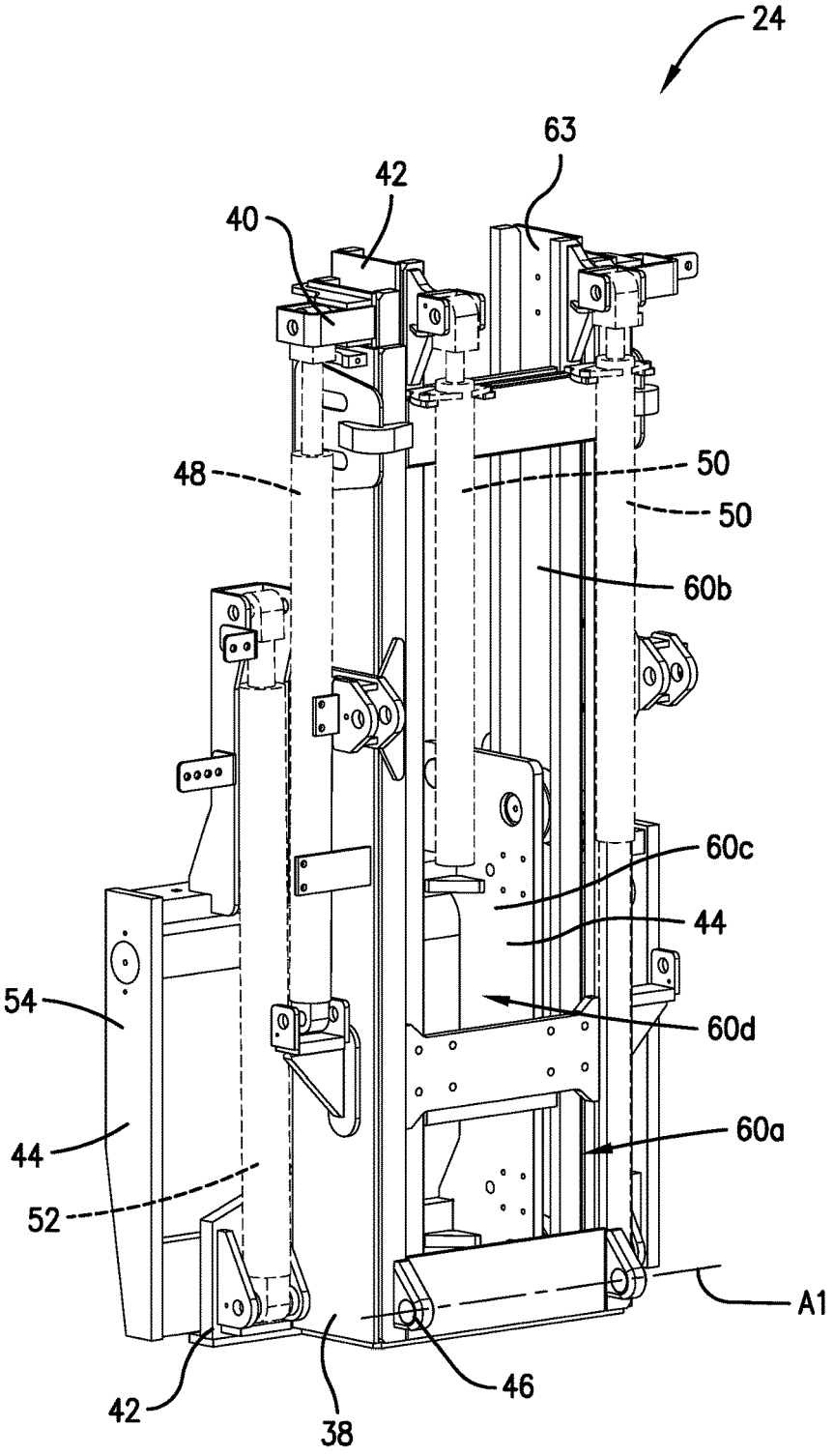
FIG. 4 is a rear perspective of the extendable mast shown in FIG. 1, showing a mast base, shiftable mast stages, and mast cylinders of the mast, with the mast cylinders being retracted so that the mast is in a retracted mast position.
Figure 5:
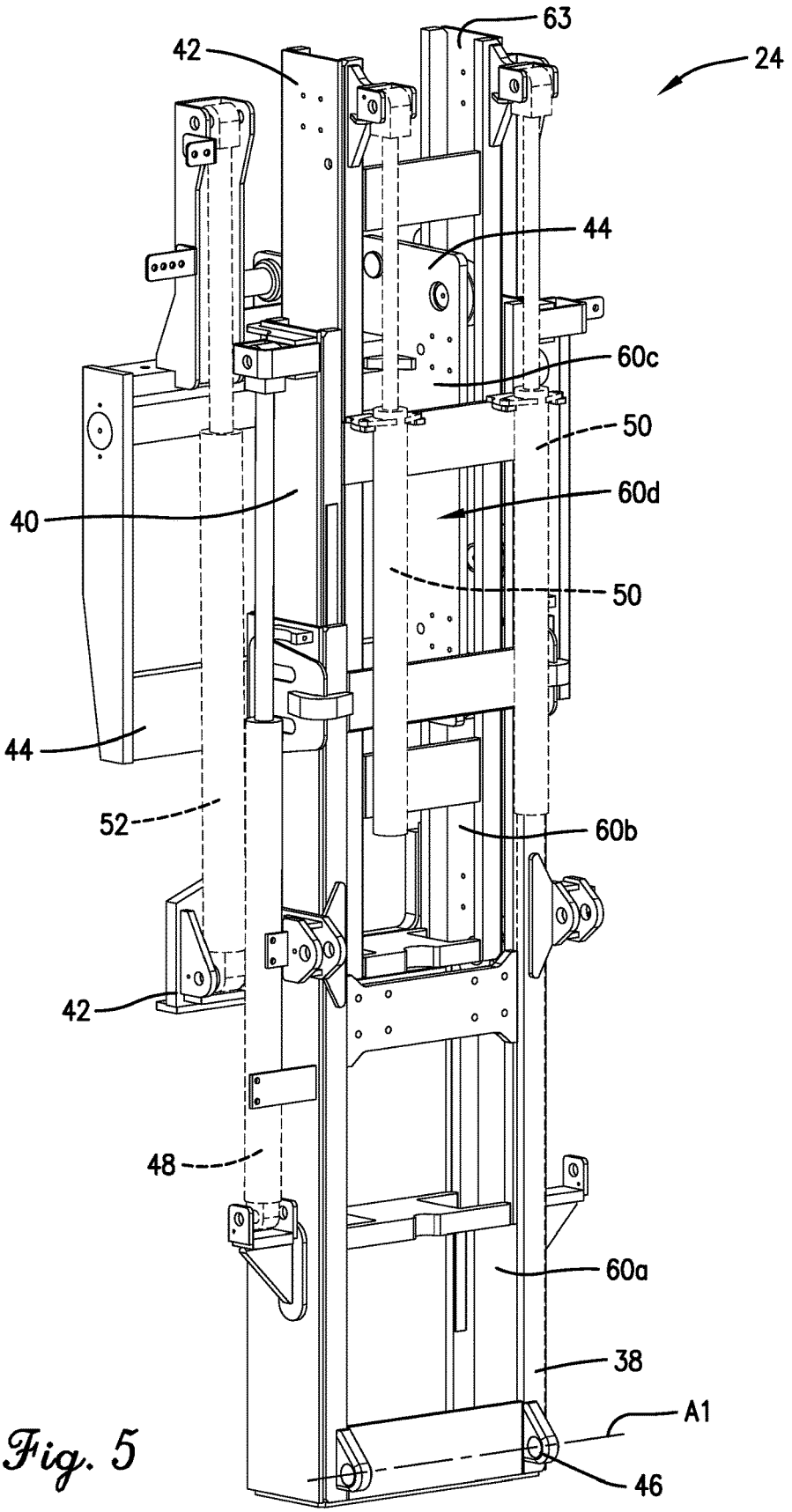
FIG. 5 is a rear perspective of the extendable mast similar to FIG. 4, but showing the mast cylinders extended to raise the shiftable mast stages to an extended mast position.

The mast base 38 comprises an elongated, rigid frame that is pivotally attached to the chassis 28 at a pivotal mounting joint 46 (see FIGS. 4 and 5). The mast base 38 can be pivoted relative to the chassis 28 about a lateral axis A1 by a hydraulic cylinder (not shown).

The first mast stage 40 comprises an elongated, rigid frame that is slidably mounted on the mast base 38. The first mast stage 40 is shiftably mounted on and slidable vertically relative to the mast base 38 to selectively extend and retract the mast 24. The mast 24 includes a first pair of hydraulic cylinders 48 that interconnect the mast base 38 and the first mast stage 40. The cylinders 48 are shiftable to selectively extend and retract the first mast stage 40 relative to the mast base 38.

The second mast stage 42 comprises an elongated, rigid frame that is slidably mounted on the first mast stage 40. The second mast stage 42 is slidable vertically relative to the first mast stage 40 to selectively extend and retract the mast 38. The mast 24 includes a second pair of hydraulic cylinders 50 that interconnect the first mast stage 40 and the second mast stage 42. The cylinders 50 are shiftable to selectively extend and retract the second mast stage 42 relative to the first mast stage 40.

The third mast stage 44 comprises an elongated, rigid frame that is slidably mounted on the second mast stage 42. The third mast stage 44 is slidable vertically relative to the second mast stage 42. The mast 24 includes a third pair of hydraulic cylinders 52 that interconnect the second mast stage 42 and the third mast stage 44. The cylinders 52 are shiftable to selectively extend and retract the third mast stage 44 relative to the second mast stage 42.

The third mast stage 44 preferably includes an adapter 54 that is operable to removably attach the third mast stage 44 to the boom assembly 26. The illustrated adapter 54 includes a lower bracket 56 and cylindrical upper lugs 58 (see FIG. 6).

The mast stages 40,42,44 and the cylinders 48,50,52 are configured to cooperatively move the adapter 54 between a lowermost retracted mast position (see FIGS. 4 and 6) and any of various raised (i.e., extended) mast positions (see, e.g., FIG. 5) where one or more of the mast stages 40,42,44 are located above the lowermost position.

The cylinders 48,50,52 are all preferably linear motors that are hydraulically driven. However, it will be appreciated that one or more of the stages could be driven by an alternative motor. For instance, one or more stages 40,42,44 of the mast 24 could include a rotary hydraulic motor, a rotary pneumatic motor, or a rotary electric motor.

The mast base 38 and the mast stages 40,42,44 preferably present corresponding mast openings 60 that extend laterally and vertically. In particular, mast base 38 presents mast opening 60*a*, mast stage 40 presents mast opening 60*b*, mast stage 42 presents mast opening 60*c*, and mast stage 44 presents mast opening 60*d*.

When the mast stages 40,42,44 are lowered to the lowermost mast position, the mast openings 60 preferably overlap with one another and cooperatively permit the operator (i.e., person P) to look through the structure of the mast 24 along a longitudinal line of sight S (see FIGS. 6 and 7).

In particular, the mast openings 60 preferably overlap one another both vertically and laterally when the mast 24 is in the lowermost mast position, with the mast openings 60 being laterally and vertically aligned with one another. In particular, the openings 60 present longitudinal axes that are substantially laterally and vertically aligned with one another. When the mast 24 is shifted to various raised positions, the mast openings 60 remain laterally aligned to cooperatively permit the operator to look through the mast 24.

In the illustrated embodiment, the mast openings 60 are in substantial registration with one another in the lowermost mast position. However, it is within the scope of the present invention where the mast openings 60 only partly overlap one another in the vertical direction and/or in the lateral direction when the mast 24 is in the lowermost mast position.

When at least partly overlapped with one another, the mast openings 60 cooperatively permit the operator to view the load L from the operator station 36 by looking through the openings 60 at the same time along the longitudinal line of sight S.

To permit the operator to view the load L from the operator station 36, the mast openings 60 preferably laterally overlap the operator station 36, a lifting end 62 of the boom assembly 26, and a space extending below the lifting end 62 (see FIGS. 6 and 7).

The mast openings 60 cooperatively define a maximum lateral opening dimension D1 of the mast 24. The dimension D1 preferably ranges from about one foot (1') to about three feet (3'), although the dimension D1 could fall outside of this range.

The mast 24 also preferably presents an uppermost opening 63 (see FIGS. 4 and 5) that removably receives the boom assembly 26 when the boom is lowered to a lowermost boom position (see FIGS. 1 and 6).

Although the illustrated lift truck 20 preferably includes the mast 24, the lift truck 20 could have an alternative mast structure without departing from the scope of the present invention. For instance, the mast 24 could include an alternative number of mast stages (e.g., an alternative mast could include the mast base and a single mast stage).

Also, for some aspects of the present invention, the lift truck 20 could be devoid of an extendable mast. For instance, the boom assembly 26 could be attached directly to the chassis 28. It is also within the scope of the present invention where the boom assembly 26 provides the sole mechanism for raising and lowering the boom relative to the chassis 28.

Turning to FIGS. 2, 3, 8, and 9, the boom assembly 26 is operable to suspend the load L above the ground G and move the load L vertically relative to the ground G and the chassis 28. The boom assembly 26 is preferably supported by the vehicle 22 distally of the operator station 36. In the illustrated embodiment, the boom assembly 26 is preferably configured as a removable boom attachment that is removable from the mast 24. The boom assembly 26 preferably includes a support frame 64, an elongated transverse boom 66, a lifting lug 67, boom lift cylinders 68, and a boom extension cylinder 70.

The transverse boom 66 preferably extends transversely relative to the length of the support frame 64 to support the load L at a location spaced distally of the support frame 64. In the illustrated embodiment, the boom 66 extends generally orthogonally to the support frame 64 and the longitudinal axis thereof. The illustrated transverse boom 66 also preferably extends in a longitudinal direction of the vehicle 22 to present a proximal mounting end 72 and the distal lifting end 62. However, it is within the scope of the present invention where the boom 66 is alternatively oriented relative to the support frame 64. The lifting end 62 is configured to support the load L in a space below the lifting end 62.

The transverse boom 66 preferably includes telescopic inner and outer boom sections 66*a,b* to change the length of the boom 66. In the illustrated embodiment, the inner boom section 66*a* is slidable into and out of the outer boom section 66*b* to selectively extend and retract the boom 66. While the telescopic construction of the boom 66 is preferred, the boom 66 could have alternative boom sections that permit extension and retraction to change the boom length. Furthermore, for some aspects of the present invention, the boom could have a fixed boom length (e.g., where the boom has a unitary rigid construction).

Figure 2:
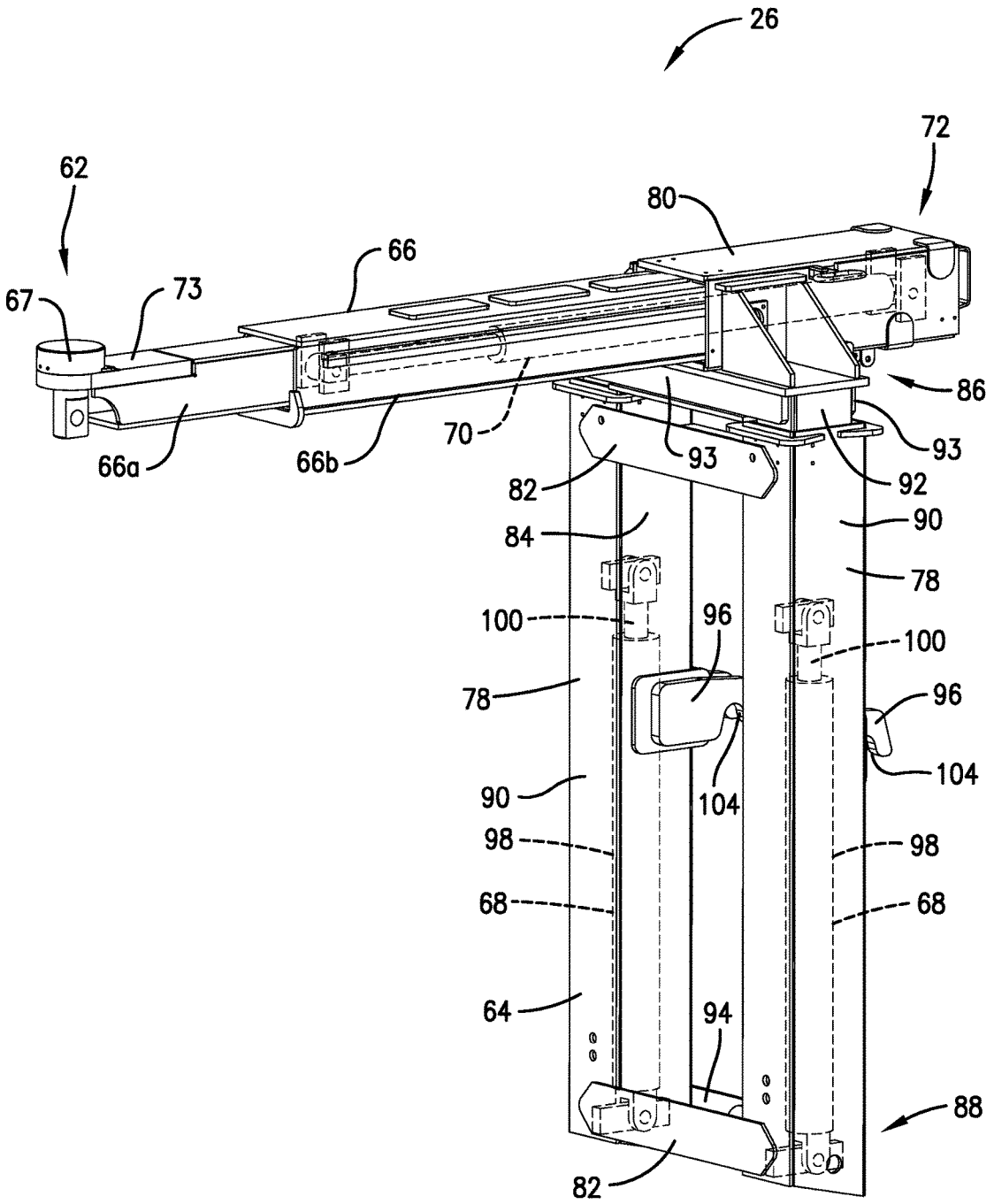
FIG. 2 is a front perspective of the boom attachment shown in FIG. 1, showing a support frame, a transverse boom, boom lift cylinders, and boom extension cylinders of the boom attachment, with the boom attachment being in a retracted boom position.
Figure 3:
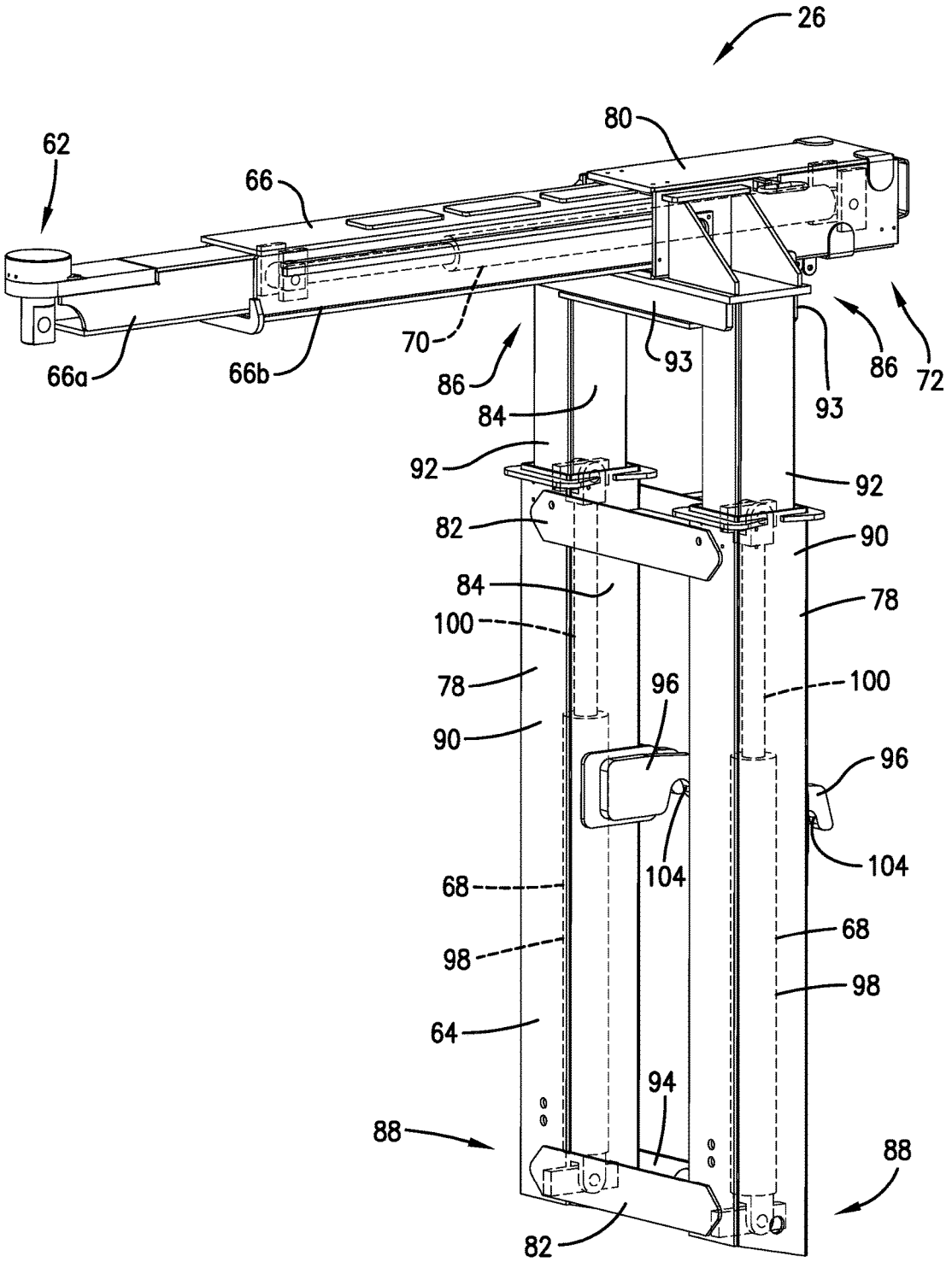
FIG. 3 is a front perspective of the boom attachment similar to FIG. 2, but showing the boom lift cylinders extended to raise the transverse boom and shiftable support sections of the support frame to an extended boom position.

The lifting lug 67 is mounted on a forward end of the inner boom section 66*a* with a plate 73 (see FIGS. 2 and 9). In the illustrated embodiment, the lifting lug 67 is configured to be attached to the load L with a clevis and straps.

The transverse boom 66 is adjustably mounted to the support frame 64. As will be discussed, the proximal mounting end 72 of the boom 66 is slidably mounted on the support frame 64.

The boom extension cylinder 70 is conventional and includes a cylinder body 74 and a rod 76 slidable into and out of the body 74 (see FIG. 9). Thus, the rod 76 is slidable to selectively extend and retract the boom extension cylinder 70.

An aft end of the body 74 is connected to the outer boom section 66*b* (see FIG. 9). A forward end of the rod 76 is connected to the inner boom section 66*a* (see FIG. 9). Thus, extension and retraction of the boom extension cylinder 70 causes corresponding forward and rearward sliding movement of the inner boom section 66*a* relative to the outer boom section 66*b*. Consequently, extension and retraction of the boom extension cylinder 70 causes extension and retraction of the boom 66.

While the extension cylinder 70 preferably comprises a hydraulic cylinder, an alternative motor could be used to extend and retract the boom 66 without departing from the scope of the present invention. For instance, the boom assembly 26 could include a rotating motor (e.g., an electric or hydraulic motor) to extend and retract the boom 66. In such alternative embodiments, the rotating motor can be drivingly attached to a transmission that converts rotation of the motor shaft to linear fore-and-aft movement of the inner boom section 66*a*.

The illustrated support frame 64 comprises a bifurcated, upright frame structure that permits the operator, to view the load L from the operator station 36 by looking through the boom assembly 26 along the longitudinal line of sight S (see FIGS. 6 and 7). The support frame 64 preferably includes a pair of telescopic supports 78, a boom mounting head 80, and braces 82.

The supports 78 are laterally spaced apart to form a bifurcated portion of the support frame 64. The supports 78 cooperatively define an upright support opening 84 that permits the operator to view the load L from the operator station 36 by looking through the support opening 84 along the longitudinal line of sight S (see FIGS. 6 and 7).

The illustrated supports 78 comprise columns that are upright and present upper and lower column ends 86,88. Each support 78 preferably includes a base support section 90 and a shiftable support section 92 in telescopically sliding engagement with one another (see FIGS. 3 and 8). The illustrated sections 90,92 include tubular bodies, with the shiftable section 92 being slidably received within the base section 90 and being axially slidable therein to move vertically.

However, it is within the scope of the present invention where the supports 78 are alternatively constructed. For instance, the base section 90 and shiftable section 92 could be slidably engaged with one another without having a telescopic construction. In one such alternative embodiment, the base section 90 and shiftable section 92 could comprise nested channel sections that slide axially relative to one another.

The shiftable sections 92 are preferably shiftable together to cooperatively move the boom 66 vertically between a lowermost retracted boom position and a range of raised (i.e., extended) boom positions. In the illustrated embodiment, the support frame 64 further includes a pair of opposite upper braces 93 (see FIG. 3) that are fixed to upper column ends 86 of the shiftable support sections 92. Thus, the braces 93 preferably interconnect the support sections 92. The upper column ends 86 of the shiftable support sections 92 are also fixed to the boom mounting head 80.

In the illustrated embodiment, the shiftable support sections 92, braces 93, and the boom mounting head 80 cooperatively form a rigid, vertically shiftable lift stage of the boom assembly 26. The boom assembly 26 preferably includes a single lift stage to provide vertical up and down movement of the boom 66. However, it is within the scope of the present invention where the boom assembly 26 includes multiple lift stages (e.g., where the boom assembly includes two, three, or four lift stages).

The support frame 64 also preferably includes a lower attachment bracket 94 (see FIGS. 2 and 6) fixed to the lower column ends 88 of the support frame 64 and a pair of lifting lugs 96 (see FIGS. 2 and 6) fixed to corresponding base support sections 90. As will be discussed, the bracket 94 and lugs 96 permit the boom assembly 26 to be removably attached to the mast 24.

The boom mounting head 80 preferably connects the supports 78 to the proximal mounting end 72 of the boom 66. As a result, the supports 78 cooperatively carry and support the boom 66 relative to the chassis 28. In the illustrated embodiment, the proximal mounting end 72 of the boom 66 is slidably mounted in a sleeve 97 of the boom mounting head 80 (see FIG. 9). This mounting configuration permits the sections 66*a*,66*b* to be moved fore and aft relative to the supports 78.

The supports 78 are preferably positioned laterally outboard of the boom 66 on opposite lateral sides thereof. Furthermore, the illustrated supports 78 are positioned so that the support opening 84 laterally overlaps the lifting end 62.

The boom lift cylinders 68 each preferably comprise a conventional hydraulically powered cylinder. Each boom lift cylinder 68 includes a cylinder body 98 and a rod 100 slidable into and out of the body 98. In the usual manner, the rod 100 is slidable to selectively extend and retract the corresponding boom lift cylinder 68.

Preferably, the lift cylinder 68 drivingly interconnects the base support section 90 and the shiftable support section 92. In the illustrated embodiment, a lower end of the body 98 is connected to the base support section 90. Also, an upper end of the rod 100 is connected to the shiftable support section 92. Thus, extension and retraction of the boom lift cylinders 68 causes corresponding upward and downward vertical movement of the shiftable support sections 92 relative to the base support sections 90. Consequently, extension and retraction of the boom lift cylinders 68 causes corresponding extension and retraction of the support frame 64.

In the illustrated embodiment, each lift cylinder 68 is preferably received and nested within the support sections 90,92. More preferably, each lift cylinder 68 is cooperatively enclosed by the corresponding pair of tubular support sections 90,92. As a result, the support sections 90,92 cover and protect the lift cylinders 68.

It has also been found that this positioning of the cylinders 68 enables the support opening 84 of the boom assembly 26 to provide a relatively large and unobstructed viewing window. However, the principles of the present invention are also applicable where the cylinders 68 are alternatively positioned. For instance, each cylinder 68 could be positioned outboard of a corresponding one of the supports 78.

While each lift cylinder 68 preferably comprises a hydraulic cylinder, an alternative lift motor could be used to extend and retract the boom assembly 26 without departing from the scope of the present invention. For instance, the boom assembly 26 could include a rotating motor (e.g., an electric or hydraulic motor) to extend and retract the boom assembly 26. In such alternative embodiments, the rotating motor can be drivingly attached to a transmission that converts rotation of the motor shaft to linear vertical movement of the shiftable support sections 92.

Again, the illustrated boom assembly 26 is preferably configured as a removable boom attachment that is removable from the mast 24. The boom assembly 26 is removably attached to the mast 24 by securing the lower brackets 56,94 to one another with a pin 102 (see FIG. 6). The boom assembly 26 is also secured by positioning the lifting lugs 96 in engagement with lugs 58 of the adapter 54. In particular, the lugs 96 present open slots 104 (see FIG. 2) that removably and slidably receive the lugs 58.

However, it is within the scope of the present invention where the boom assembly 26 is alternatively mounted to the mast 24. For instance, the support frame 64 of the boom assembly 26 could be fixed to the adapter 54 such that the support frame 64 and the adapter 54 are integrally and nonremovably connected.

The mast 24 preferably supports the boom assembly 26 relative to the chassis 28. However, for some aspects of the present invention, the lift truck 20 could be devoid of a mast. For instance, the boom assembly 26 could be attached directly to the chassis 28.

It is also within the scope of the present invention where the boom assembly 26 includes additional structure for supporting the load L. For instance, the boom assembly 26 could include a pair of elongated fork elements to extend underneath the load L and support the load L. In the usual manner, such elements are configured to support the load L by engaging a bottom surface of the load L.

In the illustrated embodiment, the operator station 36 and the support opening 84 are positioned laterally between the pair of front wheels 30 and between the pair of back wheels 32, with the support opening 84 laterally overlapping the operator station 36. Again, the illustrated supports 78 are positioned so that the support opening 84 laterally overlaps the lifting end 62.

The support opening 84 preferably defines a lateral opening dimension D2 (see FIG. 8) that preferably ranges from about one foot (1') to about three feet (3'). However, the dimension D2 could fall outside of this range without departing from the scope of the present invention.

When the boom 66 is in the lowermost boom position, the boom mounting head 80 and the boom 66 extend at least partly through the uppermost opening 63 of the mast 24 (see FIGS. 1 and 6). That is, the boom mounting head 80 and the boom 66 are at least partly nestable within the uppermost opening 63.

More preferably, the boom sections 66*a*,66*b* are located entirely below an uppermost edge 106 of the mast 24, so that the boom 66 fully nests within the opening 63, when the boom 66 is in the lowermost boom position and the mast 24 is in the lowermost mast position. Where the mast 24 is sized to fit through a predetermined doorway height in the lowermost mast position, such nesting of the boom 66 and the mast 24 enables both the boom 66 and mast 24 to fit through the same doorway.

Turning to FIGS. 1 and 7, the mast openings 60 and the support opening 84 at least partly overlap one another along a lateral direction. In particular, the mast openings 60 and support opening 84 laterally overlap one another to cooperatively permit the operator to view the load L from the operator station 36 by looking through the openings 60,84 at the same time along the longitudinal line of sight S. More preferably, the openings 60,84 present longitudinal axes that are substantially laterally aligned with one another. However, the openings 60,84 could be alternatively laterally positioned without departing from the scope of the present invention.

Preferably, the openings 60,84 cooperatively provide an unobstructed lateral viewing angle α (see FIG. 7) when the person P is seated at the operator station 36. The lateral viewing angle α preferably ranges from about five degrees (5°) to about thirty degrees (30°) and, more preferably, ranges from about ten degrees (10°) to about twenty degrees (20°).

Turning to FIGS. 1 and 6, the openings 60,84 also at least partly overlap one another along a vertical direction. Specifically, the openings 60,84 vertically overlap one another to cooperatively permit the operator to view the load L from the operator station 36 by looking through the openings 60,84 at the same time along the longitudinal line of sight S.

Preferably, the openings 60,84 cooperatively provide an unobstructed vertical viewing angle β (see FIG. 6) when the person P is seated at the operator station 36. The vertical viewing angle β preferably ranges from about ten degrees (10°) to about forty degrees (40°) and, more preferably, ranges from about twenty degrees (20°) to about thirty degrees (30°).

In operation, the lift truck 20 is configured to raise and lower the load L suspended below the boom 66 by raising and lowering the transverse boom 66. For instance, the mast 24 can be selectively extended and retracted to correspondingly raise and lower the boom 66. Similarly, the boom assembly 26 can be selectively extended and retracted to correspondingly raise and lower the boom 66.

It will also be appreciated that the mast 24 and boom assembly 26 can both be extended or retracted to cooperatively provide raising or lowering movement of the boom 66. When shifting both the mast 24 and the boom assembly 26, it will be understood that the mast 24 and the boom assembly 26 can be moved simultaneously or in series.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A boom attachment operable to be supported by a vehicle to suspend a load above the ground, said vehicle supporting an extendable mast with a mast base and an adapter shiftable vertically relative to the mast base, with the boom attachment configured to be removably mounted on the extendable mast, said boom attachment comprising:

a support frame configured to be removably attached to the vehicle; and a transverse boom that extends longitudinally to present a proximal mounting end and a distal lifting end configured to support the load in a space below the lifting end, said support frame including a pair of upright supports that are attached relative to the mounting end to cooperatively support the transverse boom, said upright supports being laterally spaced apart to cooperatively define an upright support opening that permits an operator to view the load from a location spaced proximally of the support frame by looking through the support opening along a longitudinal line of sight, said upright supports each including a base support section and a shiftable support section that is vertically shiftable relative to the base support section, with the shiftable support sections being shiftable together to cooperatively move the transverse boom vertically between a lowermost boom position and a raised boom position, at least one of said base support sections presenting a connector and being removably attached to the adapter by the connector so that the boom attachment and adapter can move with each other when the boom attachment is mounted on the extendable mast.

2. The boom attachment as claimed in claim 1, said upright supports being positioned laterally outboard of the transverse boom on opposite lateral sides thereof, with the opening laterally overlapping the lifting end.

3. The boom attachment as claimed in claim 2, said opening defining a maximum lateral opening dimension that ranges from one foot to three feet.

4. The boom attachment as claimed in claim 1, said support frame including a boom mounting head that supports the transverse boom, said upright supports presenting upper ends that are interconnected by the boom mounting head.

5. The boom attachment as claimed in claim 1, said base support section including a tubular body that telescopically receives the corresponding shiftable support section, with the shiftable support section being vertically slidable between the positions.

6. The boom attachment as claimed in claim 1; and a lift motor that drivingly interconnects the base support section and the shiftable support section to move the shiftable support section vertically relative to the base support section.

7. The boom attachment as claimed in claim 6, said base support section including a tubular body that telescopically receives the corresponding shiftable support section, with the shiftable support section being vertically slidable between the positions.

8. The boom attachment as claimed in claim 7,
said lift motor comprising a hydraulic cylinder,
said shiftable support section including another tubular body that at least partly receives the hydraulic cylinder, with the shiftable support section and the hydraulic cylinder being at least partly nested within the base support section.

9. The boom attachment as claimed in claim 1,
said connector including a pair of lugs and a bracket spaced below the lugs, with each lug associated with a respective one of the upright supports,
said lugs configured to slidably engage and rest on the adapter and said bracket configured to be pinned to the adapter, with the lugs and bracket cooperatively removably connecting the at least one base support section to the adapter when the boom attachment is mounted on the extendable mast.

10. A lift truck configured to suspend a load above the ground, said lift truck comprising:
a self-propelled vehicle defining an operator station to support an operator during lift truck use;
an extendable mast supported by the vehicle and including a mast base and an adapter shiftable vertically relative to the mast base, with the boom attachment removably mounted on the extendable mast; and
a boom attachment supported by the vehicle distally of the operator station and operable to suspend the load above the ground,
said boom attachment including a support frame attached relative to the vehicle and a transverse boom,
said transverse boom extending longitudinally to present a proximal mounting end and a distal lifting end configured to support the load in a space below the lifting end,
said support frame including a pair of upright supports that are attached relative to the mounting end to cooperatively support the transverse boom,
said upright supports being laterally spaced apart to cooperatively define an upright support opening that permits an operator to view the load from the operator station by looking through the support opening along a longitudinal line of sight,
said upright supports each including a base support section and a shiftable support section that is vertically shiftable relative to the base support section, with the shiftable support sections being shiftable together to cooperatively move the transverse boom vertically between a lowermost boom position and a raised boom position,
at least one of said base support sections presenting a connector and being removably attached to the adapter by the connector so that the boom attachment and adapter can move with each other.

11. The lift truck as claimed in claim 10,
said extendable mast presenting a mast opening that at least partly laterally overlaps the support opening, with the mast opening and support opening cooperatively pet miffing an operator to view the load from the operator station by looking through the openings at the same time along the longitudinal line of sight.

12. The lift truck as claimed in claim 11,
said extendable mast including a mast base and a shiftable mast stage that is shiftable vertically relative to the mast base,
said mast base presenting the first-mentioned mast opening and the mast stage presenting another mast opening, with the mast openings at least partly vertically overlapping one another when the transverse boom is in a lowermost boom position.

13. The lift truck as claimed in claim 11,
said vehicle including a rolling chassis with a pair of laterally spaced apart wheels,
said operator station and said support opening being positioned laterally between the wheels, with the support opening laterally overlapping the operator station.

14. The lift truck as claimed in claim 13,
said upright supports being positioned laterally outboard of the transverse boom on opposite lateral sides thereof, with the support opening laterally overlapping the lifting end.

15. The lift truck as claimed in claim 14,
said opening defining a maximum lateral opening dimension that ranges from one foot to three feet.

16. The lift truck as claimed in claim 11,
said support frame including a boom mounting head that supports the transverse boom,
said upright supports presenting upper ends that are interconnected by the boom mounting head.

17. The lift truck as claimed in claim 16,
said base support section including a tubular body that telescopically receives the corresponding shiftable support section, with the shiftable support section being vertically slidable between the positions.

18. The lift truck as claimed in claim 16; and
a lift motor that drivingly interconnects the base support section and the shiftable support section to move the shiftable support section vertically relative to the base support section.

19. The lift truck as claimed in claim 18,
said base support section including a tubular body that telescopically receives the corresponding shiftable support section, with the shiftable support section being vertically slidable between the positions.

20. The lift truck as claimed in claim 19,
said lift motor comprising a hydraulic cylinder,
said shiftable support section including another tubular body that at least partly receives the hydraulic cylinder, with the shiftable support section and the hydraulic cylinder being at least partly nested within the base support section.

21. The lift truck as claimed in claim 10,
said connector including a pair of lugs and a bracket spaced below the lugs, with each lug associated with a respective one of the upright supports,
said lugs slidably engaging and resting on the adapter and said bracket being pinned to the adapter, with the lugs and bracket cooperatively removably connecting the at least one base support section to the adapter.

* * * * *